United States Patent [19]

Fish

[11] Patent Number: 4,745,791

[45] Date of Patent: May 24, 1988

[54] PORTABLE KIT ASSEMBLY FOR STRAIGHTENING AUTOMOBILES

[75] Inventor: James A. Fish, Creve Coeur, Mo.

[73] Assignee: Maker Manufacturing Company, Inc., Creve Coeur, Mo.

[21] Appl. No.: 909,866

[22] Filed: Sep. 22, 1986

[51] Int. Cl.[4] ..... B21D 1/12

[52] U.S. Cl. ..... 72/305; 72/705

[58] Field of Search ..... 403/44, 48; 72/422, 72/705; 269/277, 280; 72/705, 305; 187/8.54; 254/100

[56] References Cited

U.S. PATENT DOCUMENTS

| | | | |
|---|---|---|---|
| 1,385,268 | 7/1921 | Paulson | 269/280 |
| 2,664,063 | 12/1953 | Makruski | 72/705 |
| 2,872,224 | 2/1959 | Osborne | 403/44 |
| 3,091,278 | 5/1963 | Padgett | 72/705 |
| 3,131,747 | 5/1964 | Junkins | 72/705 |
| 3,222,030 | 12/1965 | Thorpe | 254/100 |
| 3,355,777 | 12/1967 | Mojelski | 72/705 |
| 4,516,423 | 5/1985 | Reich | 72/705 |

*Primary Examiner*—Lowell A. Larson

*Attorney, Agent, or Firm*—Ralph B. Brick

[57] ABSTRACT

Apparatus for repairing and straightening a vehicle frame of an automobile including a rigid base frame having cantilevered beams to receive vehicle clamps adjustable thereon, the base frame being expansible and compressible within the wheel base and tread of a vehicle to be repaired and the beams extending beyond the sides of such vehicle—a jack adaptor, clamp modifiers and a link chain shortener being cooperable with the cantilevered beams.

28 Claims, 6 Drawing Sheets

PORTABLE KIT ASSEMBLY FOR STRAIGHTENING AUTOMOBILES

BACKGROUND OF THE INVENTION

The present invention relates to automobile repair hardware and more particularly to a unique portable kit assembly for straightening and repairing automobile bodies, particularly those of the unitized body type.

A large number of various types of automobile straightening devices are known in the prior art. For the most part, these past devices have proven cumbersome, and difficult to manufacture, assemble, use and store. A number of these devices have created problems in causing additional damage in fastening to the automobile body to be repaired and much of the equipment used for repair, not only has required substantial tooling and material expenses in manufacture and assembly, but has interfered with access to the parts to be repaired and has been difficult to secure relative parts to be repaired. More recent devices, such as those disclosed in U.S. Pat. No. 4,238,951, issued to James D. Grainger et al on Dec. 16, 1980 and U.S. Pat. No. 4,281,532, issued to Fred D. Covington on Aug. 4, 1981 have taught automobile straightening assemblies which allow for telescopic adjustment to accommodate for various types of automobiles. However, these structures have had many of the past limitations, including requirements for numerous parts in manufacture and assembly and the disadvantages of limited accessibility to the parts to be repaired. Moreover, past devices, including those more recent devices noted above, have been limited in the interchangeability of the several parts and thus have been limited in their capability to perform various repair operations. Although such patents as U.S. Pat. Nos. 1,909,023, issued to R. Stutz on May 16, 1933; 2,814,099, issued to D. M. Knittel on Nov. 26, 1957; 4,519,236, issued to G. Celette; and, 4,560,131, issued to L. F. Eck on Dec. 24, 1985, teach various arrangements which include a tripod or portable quadripod screw threaded jack assembly with a clamping member screwed thereon and although other patents such as U.S. Pat. No. 3,355,777, issued to W. Mojelski on Dec. 5, 1967; and U.S. Pat. No. 4,457,159, issued to D. R. Jarmin et al on July 3, 1984, teach tensioning and camming actuated clamp arrangements, none of these patents teaches the unique universal and interchangeable automobile repair hardware as taught herein which novel hardware can be readily useful either alone or in combination with a novel straightening tool.

In accordance with the teachings herein, a portable kit assembly for straightening automobiles is provided which includes among the cooperatively related several parts of the kit a novel adjustable straightening mechanism, a novel mobile transport storage cart, and novel clamp, jack and chain tensioning arrangements therefor. The selectively combined several parts of the inventive kit assembly allow for versatile adjustability, accessibility and interchangeability. The kit assembly is straightforward, comparatively light in weight, yet economical in manufacture, assembly and operation, is serviceable with a minimum of maintenance and is readily storable when not in use.

Various other features of the present invention will become obvious to one skilled in the art upon reading the disclosure set forth herein.

SUMMARY OF THE INVENTION

More particularly the present invention provides apparatus for repairing and straightening a vehicle frame of an automobile comprising: a rigid base frame sized to be positioned within a vehicle frame wheel base and vehicle tread, the base frame being expansible-collapsible to permit adjustment thereof along the longitudinal axis of a vehicle frame between the vehicle frame wheel base; beam means extending in cantilever fashion from the base frame, the beam means being sized to extend beyond the vehicle frame tread to permit ready accessibility thereto; and, clamp means slidably mounted on the beam means to permit adjustment thereon for clamp gripping connection to the vehicle frame of an automobile body. In addition, the present invention provides a cart member for transporting and storing the straightening frame, the cart member having holding means sized and contoured to receive the frame in nested relation therewith when in horizontal working position and to receive and support the frame in vertical position for storage. Further, the present invention provides a novel clamping arrangement for the frame with the main body section thereof having at least two apertures for adjustment of the clamp relative the frame, the interchangeable jaw members thereof having removable gripping plates and being replaceable by right angle jaw members for gripping in a horizontal plane. Also, the novel clamping arrangement includes eyelets to receive holding chains which can be adjusted with a novel link chain shortener and also includes a jack arrangement for supporting the frame and directly supporting the vehicle hub to be repaired.

It is to be understood that various changes can be made by one skilled in the art in one or more of the several parts of the inventive assembly without departing from the scope or spirit of the present invention. For example, different structure could be employed in making the overall frame expansible-collapsible and different ways of mounting the end caps to the frame could be employed.

BRIEF DESCRIPTION OF THE DRAWINGS

Referring to the several figures of the drawings which disclose an advantageous embodiment of the several parts of the invention.

DETAILED DESCRIPTION OF THE INVENTION

Figure 1:
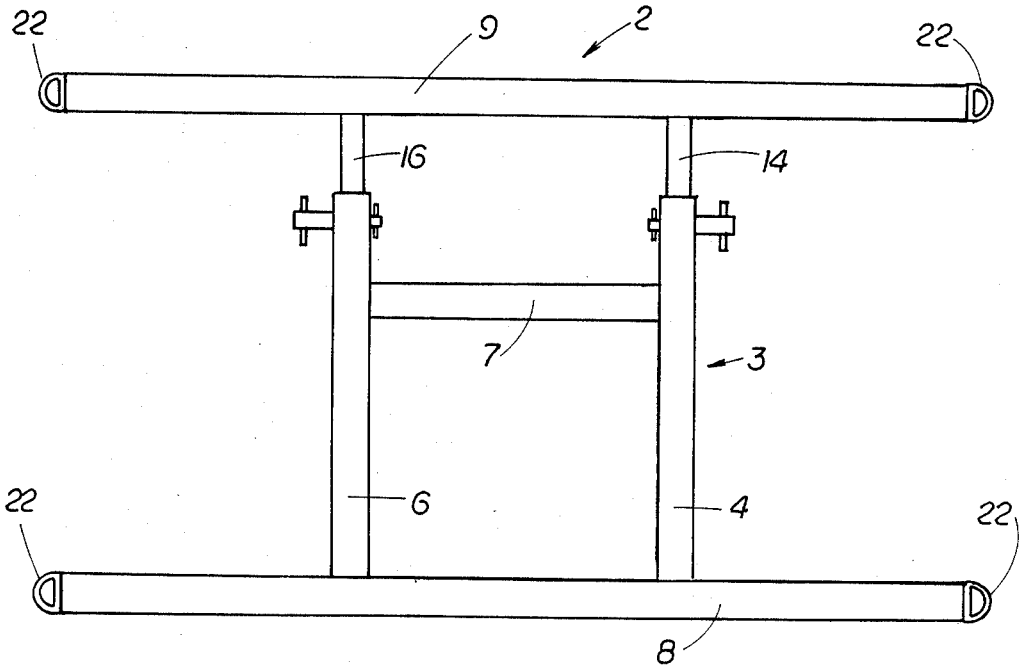
FIG. 1 is a horizontal plan view of the overall telescopic vehicle repair and straightener frame assembly.
Figure 2:
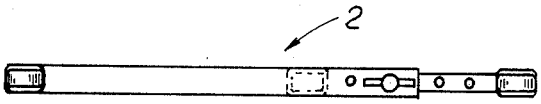
FIG. 2 is an end view of the frame assembly of FIG. 1.

Referring to FIGS. 1–4 and 6 of the drawings, the novel automobile or other types of vehicle frame straightening apparatus 2 is disclosed therein. Frame straightening apparatus 2 includes a rigid H-shaped base frame 3 comprised of spaced parallel bars 4 and 6 of hollow rectangular cross-section and similarly shaped connecting cross bar 7, the bars being formed from a suitable high strength, heavy duty steel or any other suitable high strength material. Since the bars are hollow, they are comparatively light in weight; however, it is essential that they have sufficient strength to withstand the heavy load demands placed on them. Advantageously, base frame 3 is sized to be positioned to fall well within the wheel base, vehicle tread and pinch weld of a generally standard subcompact automobile body, such as an early vintage Honda Civic. Fastened to one of the corresponding ends of spaced parallel bars 4 and 6 in perpendicular relation thereto is beam 8. It is to be understood that beam 8, which can be of like material and cross-section as bars 4, 6 and 7, can be formed as a unitary part of spaced parallel bars 4 and 6, or beam 8 can be formed separately and firmly fastened thereto by some suitable means such as welding. Arranged to extend in spaced relationship to and parallel to beam 8 is similarly sized but separately formed beam 9. Beam 9 is provided with spaced parallel bar members 14 and 16 which can be integral with or firmly fixed by welding in perpendicular relation thereto. Bars 14 and 16, which can be of like material and cross-sectional shape as bars 4 and 6, are sized and spaced to telescopically engage with hollow bars 4 and 6 respectively to permit expansible-compressible movement of bar 9 relative bar 8 to allow adjustment of the straightening frame along the wheel base of a vehicle being repaired when frame 2 is so positioned, this adjustment allowing accommodation to a generally very large car with a long wheel base, such as a Lincoln or Cadillac. In this regard, it is to be noted that the beam means of frame 2, namely beams 8 and 9, are so sized that when frame 2 is so positioned relative a vehicle to be repaired, that the four cantilevered ends thereof extend well beyond the vehicle tread of even a generally large car, as aforedescribed. Such an arrangement allows ready access beneath the vehicle being repaired and permits ready mounting of clamp assemblies, jacks and other accessories of the kit as hereinafter described in detail.

Referring to FIGS. 1–3 and 6 of the drawings, it can be seen that the sides of bars 4 and 6 and bars 14 and 16 which are respectively telescoped therein are each provided with a series of spaced apertures 17 and 18. When the apertures of the inner and outer bars are in proper alignment, suitable holding pins 19 can be inserted through the aligned apertures to hold cantilevering beams 8 and 9 in fixed telescopic relation. In this regard, it is to be noted that the spacing of the apertures of the telescoping bars can differ to allow a greater variety of adjustments. For example, the spacing between aperture centers for bars 4 and 6 can be three (3) inches and the spacing between aperture centers for bars 14 and 16 can be two (2) inches to permit selective incremental expansible-compressible adjustment of the base frame. It also would be possible to use slotted ratchet-like arrangements in each of the telescoping bars with wedging pins if so desired to allow telescopic adjustments, it being noted that the telescoping bars serve to increase the overall strength of base frame 3 for heavy duty service.

As also can be seen in FIGS. 1–4 and 6 of the drawings, each of the four cantilevered extremities of the two beams 8 and 9 is provided with an end cap or plug 21, each plug 21 having an external semi-circular loop 22 to receive a tensioning or pulling chain when so desired. Each of the plugs 21 is sized and rectangularly shaped to nest in male-female relation with its cantilevered beam end. Advantageously, plugs 21 can be fixed in position by welding, but other connections such as bayonet adjustments would also be possible.

Figure 3:
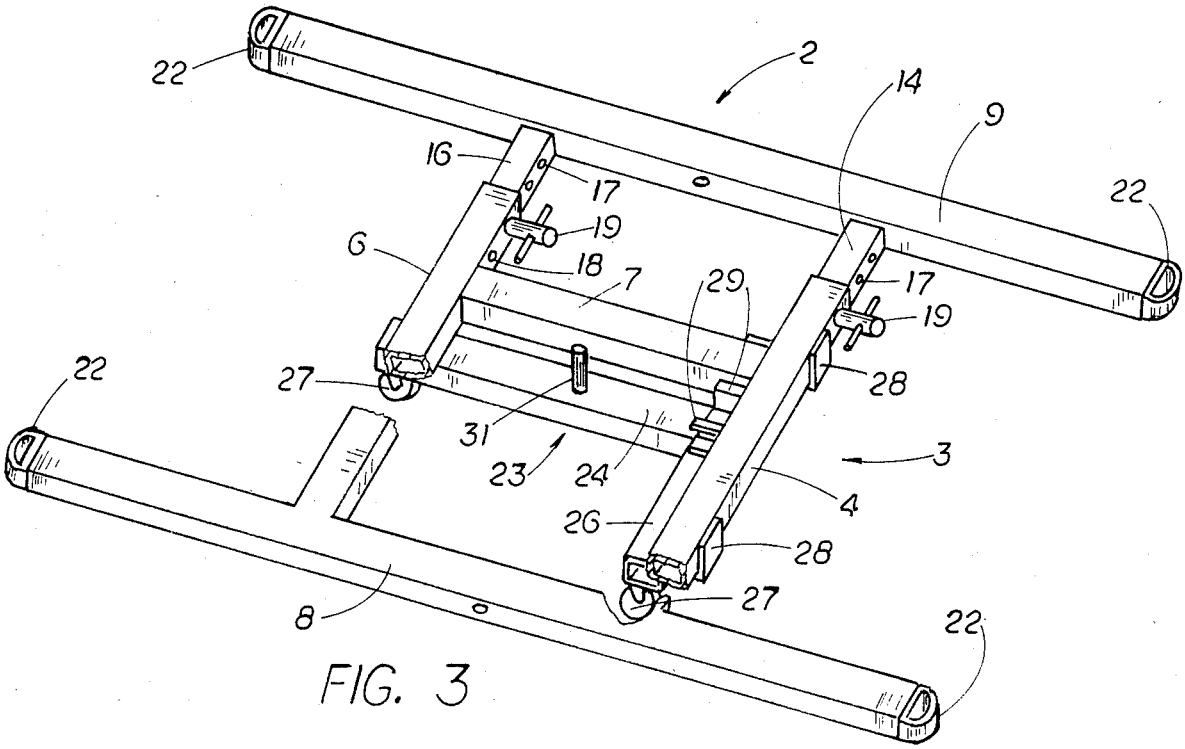
FIG. 3 is an isometric view of the frame assembly of FIGS. 1 and 2 nested and supported horizontally for movement during working operating by the novel transport and storage cart.
Figure 4:
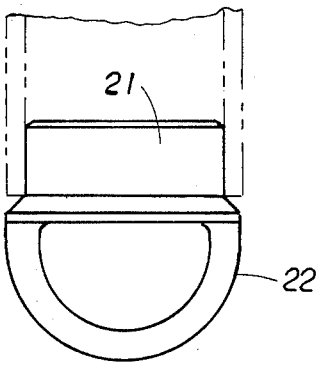
FIG. 4 is an enlarged horizontal end view of one of the four end caps mounted at the extremities of the parallel cantilevered beams of FIGS. 1–3.
Figure 5:
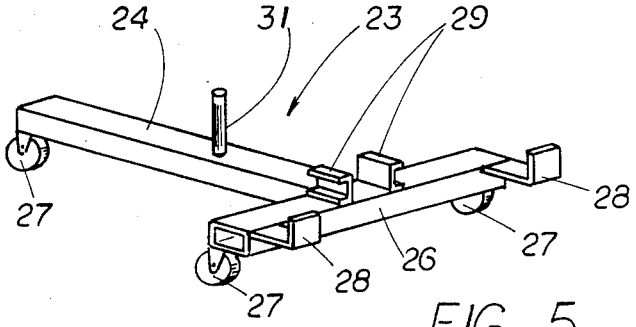
FIG. 5 is an isometric view of the frame transport and storage cart.
Figure 6:
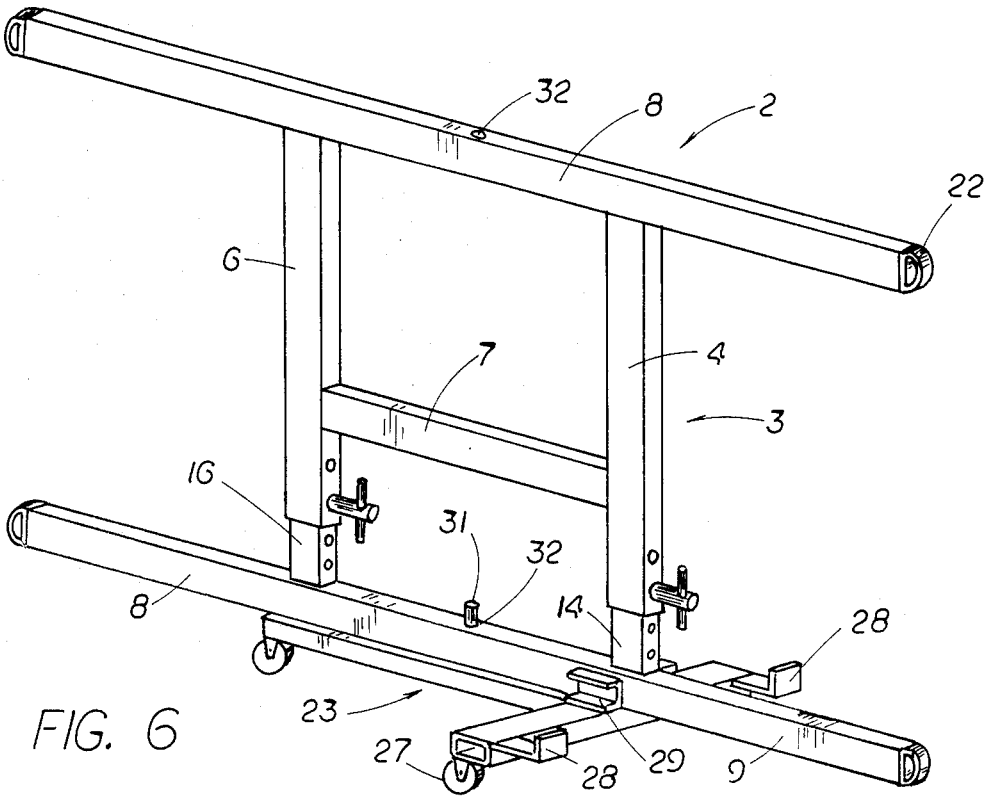
FIG. 6 is an isometric view of the frame assembly of FIGS. 1 and 2 nested and supported vertically for movement and storage by the novel transport and storage cart.

To move repair frame 2 into position underneath a vehicle to be repaired, a novel transport and storage cart 23 can be utilized. As can be seen in FIGS. 3, 5 and 6, cart 23 is of "T" shaped configuration, comprised of two rigid and sturdy hollow leg members 24 and 26 of rectangular cross-section fashioned from a suitable material, such as steel. Leg member 24, which serves as a base leg, extends perpendicular to the mid-section of leg member 26 which serves as the head leg, and is fixed thereto by some suitable means such as welding to form the "T" shaped cart assembly 23. Cart assembly 23 is provided with a set of three rollers 27 which are mounted on the bottom face thereof adjacent the outer extremities of the assembly 23. At least one of rollers 27 is pivotally mounted, advantageously the roller at the extremity of base leg 24, to enhance pivotal manipulation of assembly 23. Fixed to leg member 26, serving as the head of the T-cart, advantageously adjacent the extremities thereof, is one leg of each of a pair of spaced right angle support arms 28 which extend outwardly in a cantilever fashion from member 26. The other leg of each arm extends upwardly in spaced parallel relation with leg member 26. Also fixed to the mid-section of upper face of leg 26 with their spaced inner faces aligned with and parallel to longitudinally extending sides of base leg member 24 are the spaced and opposed vertical arms 29. As can be seen in FIG. 3 of the drawings, the sizing and spacing of arm pairs 28 and 29 and cart legs 24 and 26 are such that either telescoping legs 4 and 14 or 6 and 16 of base frame 3 can nest in the right angle arms between the outer extremities of vertical arms 29 and the vertically upright legs of right angle arms 28 with the other pair of telescoping legs resting on the extremity of base leg 24 when frame 2 is in horizontal transport and work position. When frame 2 is in vertical transport and storage position (FIG. 6), either one of beam 8 or 9 can nest in supported relation on leg 24 between vertical legs 29. In this regard, it is to be noted that base leg 24 is provided on its upper face with a vertical post 31. This post 31 serves to engage with suitable aligned apertures 32 located in the sides of each beam 8 and 9 to facilitate and stabilize vertical support of nesting frame 2.

Figure 7:
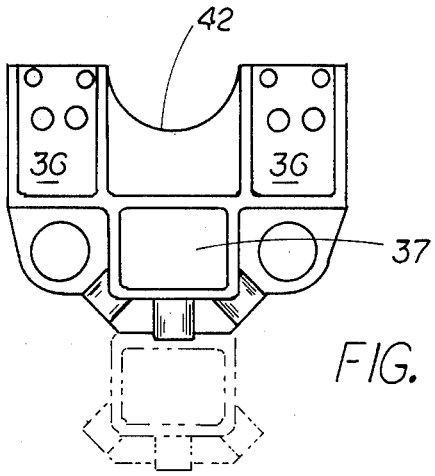
FIG. 7 is a side elevational view of the main body section of one of several novel clamps which can be slidably mounted on a cantilevered beam of the frame assembly of FIGS. 1–3 and 6.
Figure 8:
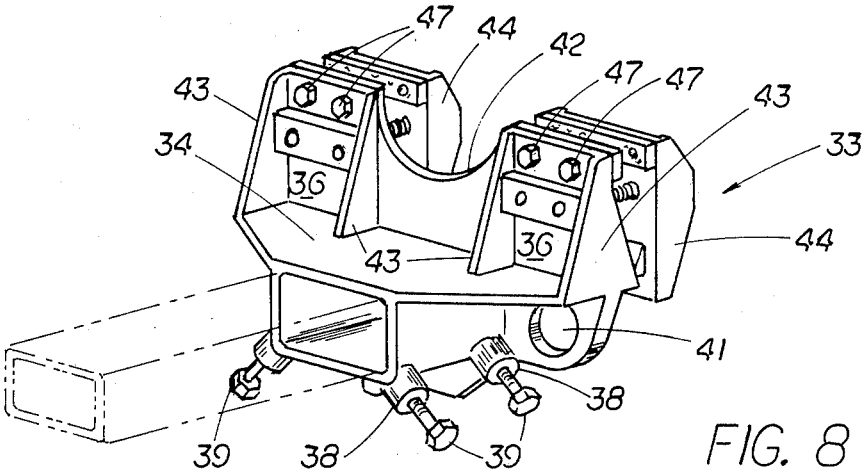
FIG. 8 is an isometric view of the clamp part of FIG. 7 showing it in assembly with opposing jaw members and mounted on a beam (shown in phantom) of a frame.
Figure 9:
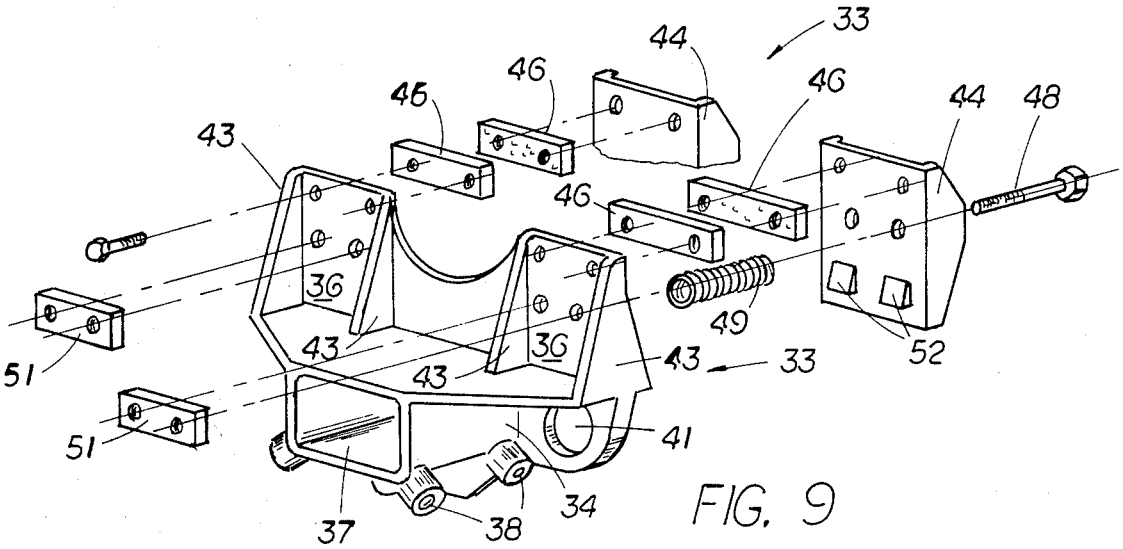
FIG. 9 is an exploded isometric view of an illustrative number of some of the several parts of the clamp assembly of FIG. 8.

Referring to FIGS. 7–9 of the drawings, a unique clamp structure 33 for the inventive kit assembly is disclosed, clamp 33 being particularly adapted for slidable adjustment on one of the four cantilevered ends of spaced beams 8 and 9. In this regard, although only one clamp assembly is disclosed in the drawings, it is to be understood that several similar clamp structures can be utilized on the cantilevered beam ends, depending upon the nature of the repair work to be accomplished and the vehicle to be repaired. Each clamp structure 33 includes a main body section 34, the upper portion being arranged to form jaw sides 36 of a clamping jaw. Integral with the lower portion of main body section 34 is aperture housing 37, the aperture being sized and rectangularly configured to slidably engage on the cantilevered end of a beam of frame 2. As disclosed in phantom, two or more apertures can be provided in a housing to allow selective positioning of the clamp relative the beam. Suitable internally threaded set screw mounts 38 to receive male threaded set screws 39 therein are provided in spaced relation along the lower portion of aperture housing 37 to allow clamp 33 to be firmly fixed in place on its cantilevered beam after the clamp has been slidably adjusted on the beam at a selected position. It is to be noted that the lower portion of main body section 34 of clamp 33 also is provided with a pair of opposed eyelets 41 to permit tensioning chains or other equipment to be tied thereto. It also is to be noted that jaw side 36 is provided with an intermediate scooped recess 42 to permit passage of rods or chains through the jaw members and enhance overall working accessibility. In effect, the scooped recess results in two spaced jaw sides 36 on each main body section 34 with each jaw side 36 being bounded on the outer face thereof by a pair of spaced tapered strengthening and stop ribs 43. Each jaw side 36 is adapted to receive an opposing jaw side 44. The upper part of each of the opposed jaw sides 36 and 44 is arranged to receive a removable grooved gripping plate 46; a pair of suitably spaced threaded bolts 47 hold each plate in mounted position on its jaw side with appropriately spaced apertures being provided in the jaw sides and plates to accommodate bolts 47—the apertures in the plates being internally threaded. To mount jaw sides 44 in opposing relation to jaw sides 36, appropriately spaced and aligned apertures are also provided in the jaw sides 36 and 44 to receive threaded bolts 48. A pair of bolts 48 is provided for each assembled jaw, each bolt passing through a spring 49 interposed between the opposed faces of the opposed jaw sides 36 and 44 to urge the jaws apart. Each pair of threaded bolts engages in the spaced pair of female threaded apertures in each single nut 51, the nut being stopped from turning by the tapered strengthening and stop ribs 43. It further is to be noted that on the opposite face of each main body section 34, spaced tapered ribs 43' are provided in opposition to ribs 43. These spaced ribs 43' serve to provide a guide recess therebetween to receive raised protrusions in the form of inclined ramps 52 to firmly position jaw sides 44 relative jaw sides 36 and to allow two jaw sides 44 to be used in opposing relation for an alternative purpose described hereinafter.

Figure 10:
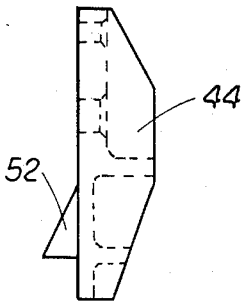
FIG. 10 is an enlarged side view of one of the jaw members of FIGS. 8 and 9, disclosing the inclined ramp on the jaw member.
Figure 11:
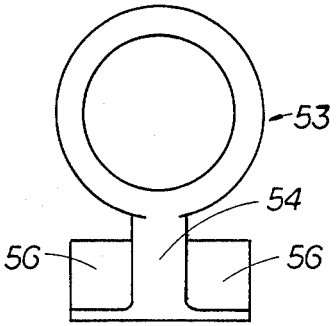
FIG. 11 is a front view of a looped pull ring which can be interposed between two connected opposing jaw members like those of FIG. 10 to provide a tensioning cam actuated clamping assembly.
Figure 12:
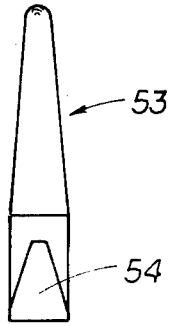
FIG. 12 is a side view of the ring of FIG. 11 to disclose the inclined ramp thereon cooperable with the ramps of opposed jaw members like those of FIG. 10.

Referring to FIGS. 10–12 of the drawings, structure for the alternative use of jaw sides 44 is disclosed as including a looped ring member 53 having integral therewith and extending therefrom ramp section 54, each ramp section 54 including a pair of spaced inclined ramps 56 sized and spaced to engage in facing inverse relation with inclined ramps 52. When ring member 53 is disposed between a pair of facing jaw sides 44 pivotally assembled together by bolts and nuts in a fashion aforedescribed with inclined ramps 52 of jaw sides 44 facing ramps 56 of looped ring member 53 in inverse relation so that the grooved gripping plates 46 to be mounted on the jaw sides 44 are at one extremity of the assembly and the loop is at the other extremity, the gripping plates 46 are urged together when the loop is moved in a direction away from gripping plates 46.

Figure 13A:
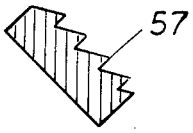
FIGS. 13*a* and 13*b* are cross-sectional views taken in planes through lines 13*a* and 13*b* of FIG. 13, disclosing the profile of the crossing diagonally extending teeth.
Figure 13:
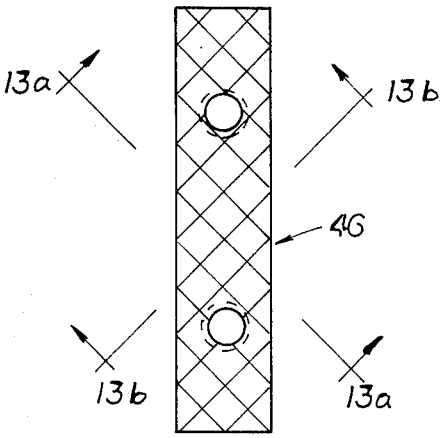
FIG. 13 is an enlarged face view of a removable gripping plate as disclosed in FIGS. 8 and 9.
Figure 13B:
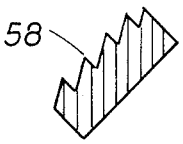

Referring to FIGS. 13, **13*a* and 13*b*, it can be seen that each gripping plate 46 includes a novel arrangement of crossing diagonally extending grooved teeth 57 and 58; these crossing teeth 57 and 58** serve to provide a plurality of small tooth points which improve gripping and inhibit directional and lateral slippage of a work piece between the opposed gripping plates during repair operations.

Figure 14:
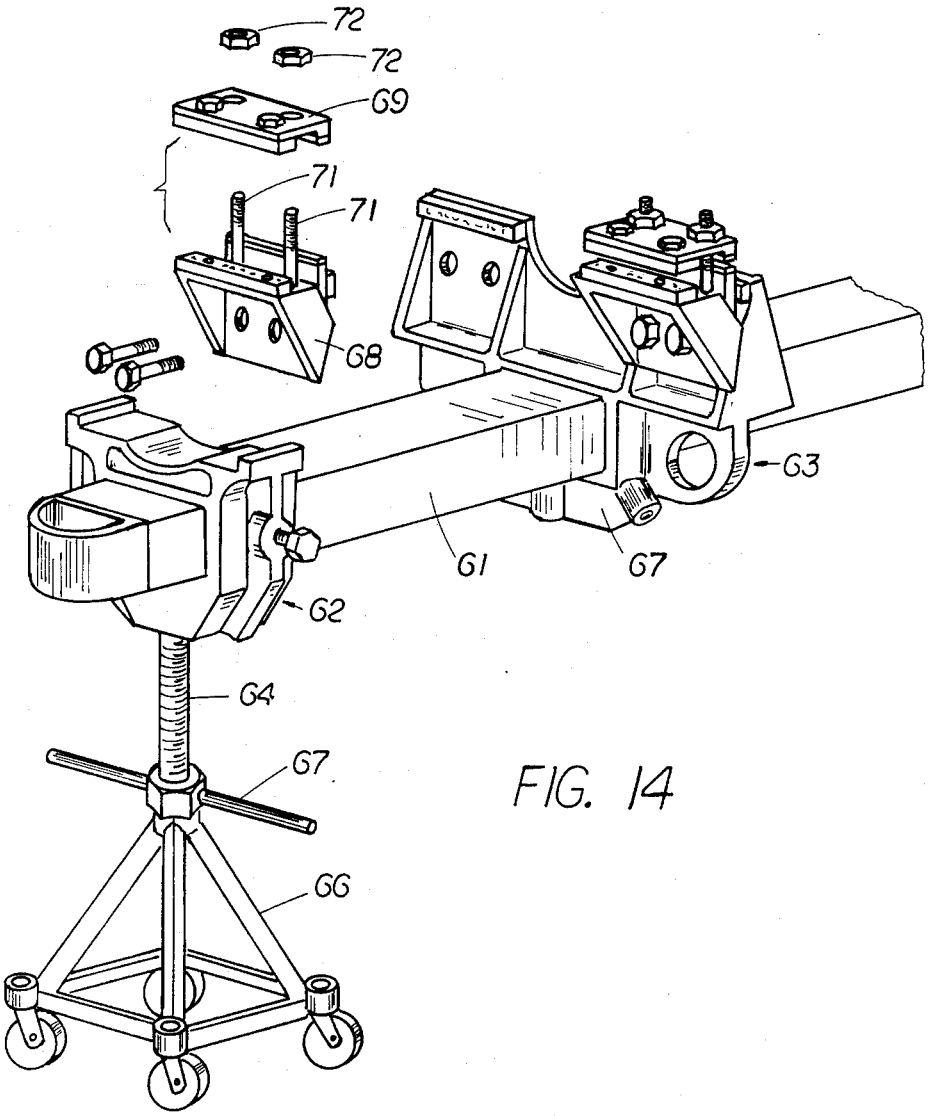
FIG. 14 is an isometric view, partially exploded, disclosing two modified support arrangements on a beam, one serving to receive the threaded end of a quadripod jack lift standard and the other serving as a clamp to receive two right angle members thereon to clamp a sheet (not shown in horizontal position)

Referring to FIG. 14, a beam 61 is disclosed which can be a separate longitudinally extending working beam forming part of the kit. It is to be understood that the parts cooperating with beam 61 described herein can also be employed with the cantilevered ends of beams 8 and 9. As shown in FIG. 14, two arrangements 62 and 63 are disclosed as slidably mounted and fixed on beam 61 with an aperture housing and set screw beam mounting arrangement similar to that above described for clamp 33 and therefor not described in detail here. The arrangement 62, which functions as one type of jack adaptor, is provided with an internally threaded socket in the bottom thereof to receive the male threaded vertically disposed lift standard 64 of a wheel mounted quadripod jack 66. A manually rotatable handle 67 serves to elevate or lower lift standard 64 and thus the end of beam 61, it being understood that like jack arrangements can be provided at the other beam extremities.

Arrangement 63 which serves as a clamp is in the form of a main body section 67 similar to main body section 47 aforedescribed for clamp assembly 33. As disclosed, main body section 67 is arranged to receive two right angle members 68; one leg of right angle member 68 is mounted as a support to main body section 67 by a suitable bolt and nut arrangement similar to that aforedescribed. One leg of right angle member 69, appropriately sized in length, extends in faced end relation with the support leg of member 68 with each of the other legs of each right angle member 68 and 69 extending in opposed horizontal relation to the other to form a clamping jaw therebetween. These overlapping horizontal legs can be connected together and be relatively adjustable with respect to each other by virtue of the spaced threaded vertical bolt and nut assemblies 71 and 72.

Figure 15:
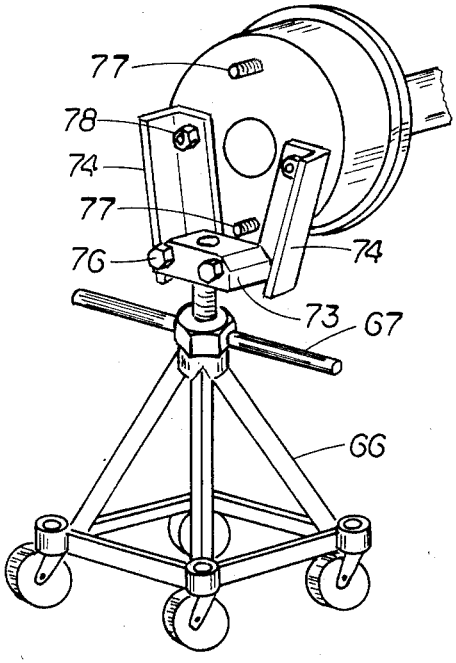
FIG. 15 is an isometric view of a jack assembly similar to that of FIG. 14 disclosing an adaptor threaded thereon with right angle clamp pieces fastened thereto and to the hub portion of a vehicle axle.

Referring to FIG. 15, another form of jack adaptor is disclosed which includes a clamp mount 73. Like arrangement 62, mount 73 is provided with an internally threaded socket in the bottom thereof to receive the male threaded vertically disposed lift standard 64 of the wheel mounted quadripod jack 66. A pair of suitable right angle clamp arms 74 are each fastened at one end thereof to mount 73 by bolts 76 and nuts (not shown). The other ends of each clamp are connected to two of the threaded hub pins 77 and fastened thereto by nuts 78.

Figure 16:
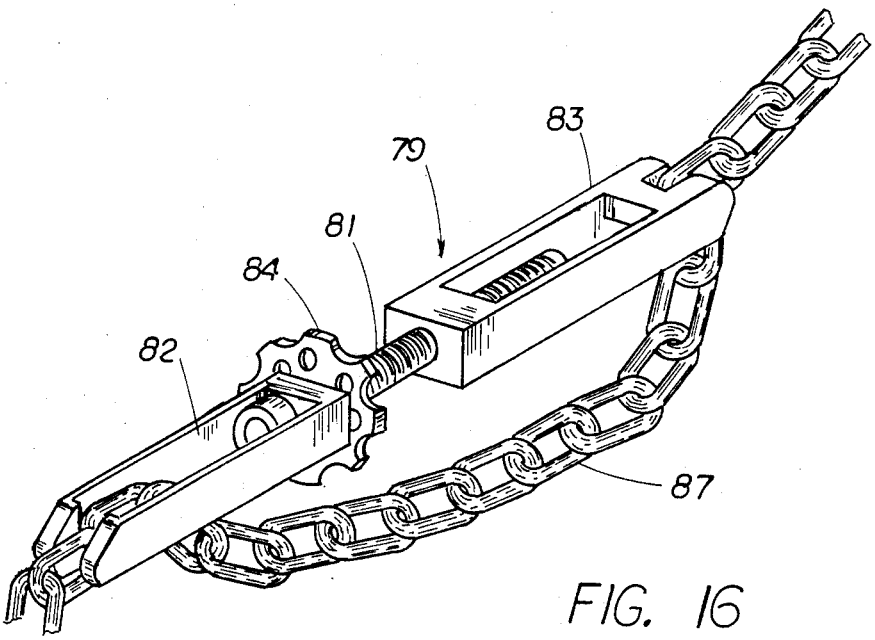
FIG. 16 is an isometric view of a link chain shortener in engagement with spaced apart or unconnected links of a chain which can have one end thereof connected to an end plug of a frame such as that disclosed in FIGS. 1–4; and, FIG. 17 is a schematic, partially broken away view of the structure of FIG. 16, disclosing hooks at opposite ends of the shortener in engagement with spaced apart chain links.
Figure 17:
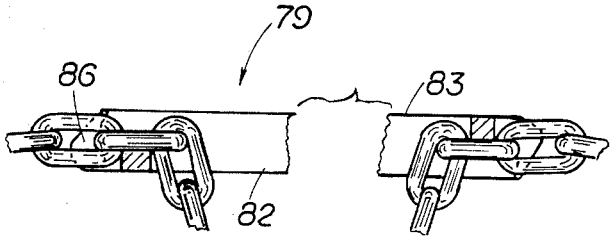

Referring to FIGS. 16 and 17 of the drawings, a novel link chain shortener 79 is disclosed. Shortener 79 includes a longitudinally extending connector rod 81 having oppositely threaded ends engaging with internally threaded ends of a pair of spaced hook brackets 82 and 83. A rotatable turning member 84 is fixed to connector rod 81, the rotation of member 84 in one direction or the other serving to selectively shorten or lengthen the distance between opposite extremities of chain shortener 79. Pivotally mounted at the opposite extremities are a pair of hooks 86. As can be seen in schematic FIG. 17, each hook 86 is arranged to engage with one of several spaced links of link chain 86, the turning of member 84 serving to lengthen or shorten the chain as desired.

From the above description, it can readily be seen that a unique and novel kit assembly of automobile repair hardware is provided for efficiently repairing a vehicle body.

The invention claimed is:

1. Apparatus for repairing and straightening a vehicle frame of an automobile body comprising:

a rigid base frame sized to be positioned within a vehicle frame wheel base and vehicle tread, said base frame being expansible-collapsible in a direction parallel to the longitudinal axis of a vehicle frame to permit adjustment of said base frame relative such longitudinal axis of the vehicle frame between the vehicle frame wheel base;

beam means connected to and extending in cantilever fashion from said expansible-collapsible base frame, said beam means being sized to extend beyond the vehicle frame tread to permit ready accessibility thereto and being relatively moveable in one direction or another as said base frame is respectively expanded and collapsed; and, clamp means slidably mounted on said beam means to permit adjustment thereon for clamp gripping connection to the vehicle frame of an automobile body.

2. The apparatus of claim 1, said rigid base frame being sized to be positioned within a vehicle frame wheel base and vehicle tread of a subcompact automobile body and said beam means being sized to extend beyond the vehicle frame tread of a large standard size automobile.

3. The apparatus of claim 1, said rigid base frame including a pair of spaced parallel structural members connected together by at least one cross-structural member to form an H section;

said beam means including a pair of spaced parallel structural members extending transversely perpendicular to said parallel structural members of said base frame, one of said structural beam members being fixed to said spaced structural members of said base frame and the other being slidably adjustable relative thereto to provide said expansible-compressible adjustment between a vehicle frame wheel base.

4. The apparatus of claim 1, said rigid base frame including a pair of spaced parallel hollow structural members connected together by at least one cross-structural member to form an H-section;

said beam means including a pair of spaced parallel structural beam members extending transversely perpendicular to said parallel structural members of said base frame, one of said structural beam members being fixed to said spaced structural members of said base frame at one end thereof and the other having fixed spaced parallel leg members extending perpendicularly therefrom in telescopic relation with the other end of said spaced structural members of said base frame to be slidably adjustable relative thereto to provide said expansible-compressible adjustment.

5. The apparatus of claim 1, said rigid base frame including a pair of spaced parallel hollow structural members of rectangular cross-section connected together by at least one cross-structural member to form an H-section;

said beam means including a pair of spaced parallel structural beam members extending transversely perpendicular to said parallel structural members of said base frame, one of said structural beam members being fixed to said spaced structural members of said base frame at corresponding extremities thereof and the other having fixed spaced parallel leg members extending perpendicularly therefrom at rectangular cross-section sized to engage in male-female telescopic relation with the other end of said spaced structural members of said base frame, said telescoping members having spaced apertures therein with the apertures of the male members being spaced a different distance than the apertures of the female members to permit selective incremental expansible-compressible adjustable relation when preselected spaced male and female apertures are aligned; and fastening pins sized to be inserted through aligned apertures to hold said telescopic members in preselected fixed relation.

6. The apparatus of claim 1, said beam means having a hollowed cross-sectional extremity; and, end cap plug means sized to engage in male-female relation with said extremity to be fixed thereto, said plug means having a looped extremity to anchor the end of pulling member therewith.

7. The apparatus of claim 1, said beam means including a pair of spaced parallel hollow structural beam members of rectangular cross-section; and, end cap plug members sized and rectangularly shaped to engage in male-female relation with the opposite extremities of said pair of spaced hollow structural members, each of said plug means having a looped semi-circular extremity integral therewith to anchor the end of a pulling member therewith.

8. The apparatus of claim 1, including:

a cart member sized and contoured to receive and support in nested relation therewith said rigid base frame when said frame is in horizontal transport working position to permit movement of said base frame relative a vehicle frame to be repaired and the expanding and collapsing of said base frame during vehicle frame repair operations.

9. The apparatus of claim 1, including:

a cart member having first holding means sized and contoured to receive and support in nesting relation therewith said rigid base frame when said frame is in horizontal transport working position to permit movement of said frame relative a vehicle frame to be repaired and a second holding means sized and contoured to receive and support in nesting relation therewith said beam means when said frame is in vertical position for storage.

10. The apparatus of claim 1, including a cart having two structural leg members, one of which serves as a base member to extend perpendicular to the mid-section of the other which serves as a head member and is fixed thereto to form a "T" shaped cart assembly;

a set of rollers mounted on the bottom face thereof adjacent the extremities of said cart assembly, at least one of said rollers being pivotally mounted;

a pair of spaced right angle arms, one leg of each arm fixed to and extending outwardly in cantilever fashion intermediate the extremities of the structural leg member forming the head of said T-cart assembly and the other leg extending upwardly and parallel such structural leg member;

a pair of spaced vertical arms extending upwardly from the mid-section of the upper face of the structural leg forming the head of said T-cart assembly and parallel the structural base leg member perpendicular to the structural leg member forming the head of said T-cart assembly, said pair of right angle arms receiving and nesting with said base frame when said frame is in horizontal transport working position and said vertical arms receiving and nesting with said beam means when said frame is in a vertical storage position;

said base leg having a vertical pin mounted thereon adapted to engage with aligned apertures in said beam means when said frame is in vertical storage position.

11. The apparatus of claim 1, said clamp means including sets of clamp members, each having a main body section with at least one aperture therein sized to engage with said cantilever beam means to be slidably adjustable thereon, said main body section forming a first jaw member of at least one pair of opposed clamping jaws; and, a second jaw member moveably mounted relative said first jaw member to form said pair of opposed clamping jaws.

12. The apparatus of claim 1, said clamp means including sets of clamp members, each having a main body section with at least two spaced apertures therein, each sized to engage selectively with said cantilever beam means to be slidably adjustable thereon permitting selective spacing of said clamp means relative said cantilever beam means depending upon the aperture selected, said main body section forming a first jaw member of at least one pair of opposed clamping jaws; and, a second jaw member moveably mounted relative said first jaw member to form said pair of opposed clamping jaws.

13. The apparatus of claim 1, said clamp means including sets of clamp members, each having a main body section forming a first jaw member of at least one pair of opposed clamping jaws;

a second jaw member moveably mounted relative said first jaw member to form said pair of opposed clamping jaws; and said opposed jaw members having gripping plates with facing grooved surfaces removably mounted thereon to insure a positive grip during work operations and to permit removal and replacement.

14. The apparatus of claim 1, said clamp means including sets of clamp members, each having a main body section forming a first jaw member of at least one pair of opposed clamping jaws;

a second jaw member moveably mounted relative said first jaw member to form said pair of opposed clamping jaws; and said opposed clamping jaws including facing grooved surfaces to insure a positive grip during work operations, said grooved surfaces including crossing diagonally extending grooved teeth to inhibit lateral slippage.

15. The apparatus of claim 1, said clamp means including sets of clamp members, each having a main body section forming a first jaw member of at least one pair of opposed clamping jaws;

a second jaw member moveably mounted relative said first jaw member to form said pair of opposed clamping jaws, one of said jaw members having a raised surface adjacent its gripping face and the other a recessed guide, said raised surface and guide being sized to be nestingly engageable.

16. The apparatus of claim 1, said clamp means including sets of clamp members, each having a main body section slidably mounted on said beam means and forming a first gripping jaw member of at least one pair of opposing clamping jaws;

a second jaw member detachably and moveably mounted relative said first jaw member, each having gripping portions to form said pair of opposed clamping jaws, one of jaw members having a raised surface in the form of an inclined ramp adjacent its gripping face and the other a recess guide, said inclined ramp and recessed guide being sized to be nestingly engageable; and, a looped ring member having an inclined ramp section extending therefrom cooperable with the inclined ramps of a pair of facing jaw members with such ramps when disposed therebetween and said jaw members are pivotally connected together so as to urge said gripping portions of said jaw members together when said loop is moved in a direction away from the gripping portions of said facing jaw members having inclined ramps.

17. The apparatus of claim 1, said clamp means including sets of clamp members, each having a main body section forming a first jaw member of at least one pair of opposed clamping jaws;

a second jaw member moveably mounted relative said first jaw member to form said pair of opposed clamping jaws;

said pair of opposed clamping jaws each having a pair of aligned bolt receiving apertures therein;

a pair of threaded bolts extending through said aligned apertures; and, a nut having a pair of spaced female threaded apertures alignable with said aligned jaw aperture pairs to receive said bolts in threaded male-female relation.

18. The apparatus of claim 1, said clamp means including sets of clamp members having a main body section and, a pair of right angle members, one leg of each of which can be mounted as a support to said main body section with each of the other legs extending in opposed horizontal relation to the other with one of such opposed legs overlapping the other to form a clamping jaw therebetween, said opposed support legs being relatively moveable to provide for clamping jaw adjustment.

19. The apparatus of claim 1, and jack adaptor means slidably mounted on said beam means, said jack adaptor means including an aperture to nestingly engage said beam means and threaded male-female coupling connections on said jack adaptor means and a lift standard of a jack means therefor for mating coupling of said threaded jack adaptor means to the threaded lift standard of said jack means.

20. Apparatus for repairing and straightening a vehicle frame of an automobile body comprising:

a rigid base frame sized to be positioned within a vehicle frame wheel base and vehicle tread of a subcompact automobile body, said base frame including a pair of spaced parallel hollow structural members of rectangular cross-section connected together by at least one cross-structural member to form an H-section;

beam means extending in cantilevered fashion from said base frame, said beam means including a pair of spaced parallel structural beam members extending transversely perpendicular to said parallel structural members of said base frame sized to extend beyond the vehicle frame tread on both sides of the automobile body to permit ready accessibility thereto, one of said beam structural members being fixed to said spaced structural members of said base frame at corresponding extremities thereof and the other beam structural member having fixed spaced parallel leg members extending perpendicularly therefrom of rectangular cross-section sized to engage in male-female telescopic relation with the other end of said spaced structural members of said base frame, said telescoping members having spaced apertures therein with the apertures of the male members being spaced a different distance than the apertures of the female members to permit selective incremental expansible-compressible adjustable relation when preselected spaced male and female apertures are aligned;

fastening pins sized to be inserted through aligned apertures to hold said telescopic members in preselected fixed relation;

end cap plugs sized and rectangularly shaped to engage in male-female relation with the extremities of said spaced parallel structural beam members to be welded in fixed position thereto, each plug having a looped semi-circular extremity to anchor the end of a pulling member thereto;

a cart having two structural leg members, one of which extends perpendicular to the mid-section of the other and is fixed thereto to form a "T"-shaped cart assembly; said cart including a set of rollers mounted on the bottom face thereof adjacent the extremities of said cart assembly, at least one of which is pivotally mounted thereon, said cart further including a pair of spaced right angle arms, one leg of each arm fixed to and extending outwardly in cantilever fashion adjacent the extremities of the structural leg member forming the head of the T-cart assembly and the other leg extending upwardly and in spaced parallel relation with such structural leg member, said cart also including a pair of spaced vertical arms fixed to and extending upwardly from the mid-section of the upper face of the structural leg forming the head of the T-cart assembly and parallel the longitudinal sides of that structural leg member perpendicular to the structural leg member forming the head of the T-cart assembly, said pair of right angle arms and said vertical legs receiving and nesting with one leg of said base frame with the other leg of said base frame resting transversely across the extremity of the other leg of the T-cart assembly when said base frame is in horizontal transport working position and said vertical arms on said T-cart receiving and nesting with one leg member of said spaced beams 8 and 9 when said frame is in vertical storage position;

clamp means slidably mounted on said beam means to permit adjustment thereon for clamp gripping connection to the vehicle frame of an automobile body, said clamp means including sets of clamp members, each having a main body section forming a first jaw member with at least one rectangular aperture therein sized to engage with said cantilever beam means to be slidably adjustable thereon and a second jaw member moveably mounted relative said first jaw member to form a pair of opposed clamping jaws, said jaws being grooved to provide gripping portions to insure positive grip during work operations, one of said jaw members having a raised surface in the form of an inclined ramp on its gripping face and the other a recessed guide, said ramp and guide being sized to be nestingly engageable;

a looped ring member having an inclined ramp section extending therefrom cooperable with the inclined ramps of a pair of facing jaw members having such ramps when disposed therebetween and said jaw members having such ramps are pivotally connected together to urge said gripping portions of said jaw members together when said loop is moved in a direction away from the gripping portions;

said clamping means including at least one pair of right angle members, one leg of one of which can be mounted as a support to one of said main body sections with one leg of the other in faced end relation with each of the other legs of each right angle member extending in opposed horizontal relation to the other to form a clamping jaw therebetween, said support legs being relatively moveable to provide for clamping adjustment;

jack adaptor means slidably mounted on said beam means, said jack adaptor means including female threaded connections for threaded coupling to a male threaded lift standard of a jack means;

a jack means having a male threaded lift standard to engage in male-female thread coupled relation with said jack adaptor; and, link chain means fastenable to said apparatus, said link chain means including a longitudinally adjustable chain shortening means comprised of a pair of two spaced apart hooks, each having a threaded female connection socket integral therewith with the connection socket of one hook being oppositely threaded relative the connection socket of the other; and, a connector rod having oppositely threaded extremities engageable in male-female relation with the pair of oppositely threaded connection sockets, said connector rod having a rotatable turning member fixed thereto so that when said pair of hooks are engaged in spaced apart links, the spacing therebetween can be adjusted by rotating said turning member, thereby adjusting chain tension.

21. In an automotive repair kit, a cart member for transporting and storing an automobile straightening frame, said cart member having a first holding and support means sized and contoured to receive in nested relation therewith said frame when said frame is in horizontal transport working position to permit movement of said frame relative a vehicle frame to be repaired; and, a second holding means sized and contoured to receive and support in nested relation therewith said frame when said frame is in vertical position for storage.

22. The apparatus of claim 21, said cart member having two structural leg members, one of which serves as a base member to extend perpendicular to the mid-section of the other which serves as a head member and is fixed thereto to form a "T"-shaped cart assembly;

a set of rollers mounted on the bottom face thereof adjacent the extremities of said cart assembly, at least one of said rollers being pivotally mounted;

said first holding means including a pair of spaced right angle arms with one leg of each arm fixed to and extending outwardly in cantilever fashion intermediate the extremities of said structural leg member forming the head of said T-cart assembly and the other leg extending upwardly and parallel such structural leg member;

said second holding means including a pair of spaced vertical arms extending upwardly from the mid-section of the upper face of the structural leg forming the head of said T-cart assembly and parallel the structural base leg member, said pair of right angle arms receiving and supportively nesting with a portion of said frame when in horizontal transport position and said vertical arms receiving and supportively nesting with a portion of said frame when in vertical storage position.

23. In an automotive repair kit, a clamp member for slidably mounting on a beam of a straightening frame, said clamp member having a main body section with said main body section having at least two spaced corresponding apertures extending parallel each other therein, each being sized to engage selectively with said beam to be slidably adjustable thereon permitting selective spacing of said clamp means relative said beam depending upon the aperture selected, said main body section forming a first jaw member of at least one pair of opposed clamping jaws; and a second jaw member moveably mounted relative said first jaw member to form said pair of opposed clamping jaws.

24. The clamp structure of claim 23, said opposed clamping jaws having gripping plates with facing grooved surfaces removably mounted thereon to insure positive grip during working operations and to permit removal and replacement.

25. The clamp structure of claim 23, one of said jaw members having a raised surface adjacent its gripping face and the other a recessed guide sized to be nestingly engageable by said raised surface.

26. The clamp structure of claim 23, one of said jaw members having an inclined ramp adjacent its gripping face and the other a recessed guide, said ramp and guide being sized to be nestingly engageable; and, a looped ring having an inclined ramp section extending therefrom cooperable with the inclined ramps of a pair of facing jaw members when inversely disposed therebetween and said jaw members are pivotally connected together to urge said gripping portions of said jaw members together when said loop is moved in a direction away from the gripping portions of said facing jaw members having inclined ramps.

27. The clamp structure of claim 23, said opposed clamping jaws each having a pair of aligned bolt receiving apertures therein;

a pair of threaded bolts extending through said aligned apertures; and, a nut having a pair of spaced female threaded apertures alignable with said aligned jaw aperture pairs to receive said bolts in threaded male-female relation.

28. The clamp structure of claim 23, and two right angle members, one leg of one of which can be mounted as a support to said main body section with one leg of the other in faced end relation and with each of the other legs of each right angle member extending in opposed horizontal relation to the other with one of such opposed legs overlapping the other to form a clamping jaw therebetween, said support legs being relatively moveable to provide for clamping jaw adjustment.

* * * * *